US007104192B1

(12) United States Patent
Corcoran

(10) Patent No.: US 7,104,192 B1
(45) Date of Patent: Sep. 12, 2006

(54) HINGED COVER FOR A CUTTING AND EMBOSSING DIE SET

(75) Inventor: Kevin L. Corcoran, Mission Viejo, CA (US)

(73) Assignee: Ellison Educational Equipment, Inc., Lake Forest, CA (US)

( * ) Notice: Subject to any disclaimer, the term of this patent is extended or adjusted under 35 U.S.C. 154(b) by 0 days.

(21) Appl. No.: 11/245,740

(22) Filed: Oct. 7, 2005

(51) Int. Cl.
*B31F 1/07* (2006.01)

(52) U.S. Cl. ..... 101/23; 101/28; 101/3.1

(58) Field of Classification Search ..... 101/28
See application file for complete search history.

(56) References Cited

U.S. PATENT DOCUMENTS 5,054,389 A * 10/1991 Kuhlman et al. ..... 101/28
5,722,319 A * 3/1998 Hirano ..... 101/23
2004/0099113 A1* 5/2004 Hixon et al. ..... 83/128
2004/0118304 A1* 6/2004 Corcoran et al. ..... 101/28

* cited by examiner

*Primary Examiner*—Daniel J. Colilla
*Assistant Examiner*—Marissa Ferguson-Samreth
(74) *Attorney, Agent, or Firm*—Morland C. Fischer

(57) ABSTRACT

A hinged cover for a cutting and embossing die set by which a sheet material can be simultaneously cut and embossed. The cutting and embossing die set includes a die and a counter-die. A hinged cover includes first and second adjacent backing members that are hingedly coupled to one another and rotatable from an open configuration to a closed configuration. Each of the first and second backing members has a cavity formed therein. The die and the counter-die are fixedly retained within respective ones of the cavities formed in the first and second backing members of the hinged cover. With the cover rotated to the closed configuration, a compressive force is applied to the first and second backing members thereof. A sheet material that is sandwiched between the die and counter-die of the die set is embossed and cut when first and second raised male portions which project from the die are pressed against the counter-die.

5 Claims, 2 Drawing Sheets

HINGED COVER FOR A CUTTING AND EMBOSSING DIE SET

BACKGROUND OF THE INVENTION

1. Field of the Invention

This invention relates to a hinged cover to surround and align a die and a counter-die of a cutting and embossing die set. The hinged cover is rotatable from an open configuration to a closed configuration to correspondingly move raised male portions of the die into receipt by recessed female portions of the counter-die so that sheet material sandwiched between the die and counter-die can be simultaneously embossed and cut.

2. Background Art

Cutting and embossing die sets are known having a male die and a female counter-die for embossing and cutting sheet material that is placed therebetween. In one case, a hinge runs along the interface of the die and the counter-die. In this manner, the male die is pivotally connected and rotatable relative to the female counter-die. The die is rotated at the hinge to lie overtop the counter-die. Pressure is then applied to the die set to press a raised embossing pattern from the die into a matching recess formed in the counter-die.

Such a cutting and embossing die set has several shortcomings. First, the male die and the female counter-die are typically thin. Therefore, it is often difficult to properly locate and retain the die set in the jaws of some force generating presses. Because of its thin profile, the die and counter-die may not receive sufficient pressure for adequately embossing and cutting the sheet material located therebetween.

In this same regard, when the die is rotated over the counter-die, the raised embossing pattern may not be accurately aligned for receipt by the recess. Consequently, the sheet material may be only partially embossed or not embossed at all. Moreover, the raised embossing pattern and/or the opposing recess may sustain damage after only a few embossing cycles, because of their misalignment and the resulting clash of the die against the counter-die in response to the force generated by the press. Such damage can result in the die set having to be scrapped inasmuch as the sheet material can no longer be suitably embossed.

SUMMARY OF THE INVENTION

A hinged cover for a cutting and embossing die set is disclosed by which a sheet material can be simultaneously cut and embossed. The cutting and embossing die set includes a die and a matching counter-die. The die has first and second raised male portions projecting therefrom, and the counter-die has a first recessed female portion formed therein that is sized and shaped to receive the first raised male portion of the die. The first raised male portion of the die may be arranged to illustrate indicia and/or graphic designs so that different messages can be embossed into the sheet material.

The hinged cover includes first and second adjacent backing members. An integral hinge runs along the interface between the first and second backing members by which the backing members are pivotally connected to one another. Each of the backing members has a cavity formed therein. The die and the counter-die of the cutting and embossing die set are fixedly disposed in respective ones of the cavities formed in the first and second backing members in order to prevent the die and counter-die from moving relative to one another.

A sheet material to be embossed is located on top of the counter-die. The cover is then rotated at the hinge from an open configuration to a closed configuration, whereby the die carried by the first backing member of the cover will lie over the counter-die carried by the second backing member of the cover with the sheet material sandwiched between the die and the counter-die. By virtue of the first and second backing members, the first raised male portion of the die will be accurately aligned for receipt by the recessed female portion of the counter-die. The hinged cover is then positioned below the roller or between the jaws of a press. The first and second backing members of the cover in the closed configuration provide the die set with an additional thickness so that a compressive force generated by the press will be imparted through the backing member to the die and counter-die for embossing the sheet material when the first raised male portion of the die is pushed into the recessed female portion of the counter-die. At the same time, the second raised male portion of the die is forced into contact against the face of the counter-die for cutting the sheet material in a pattern that is defined by the shape of the second raised male portion.

DESCRIPTION OF THE PREFERRED EMBODIMENT

Figure 1:
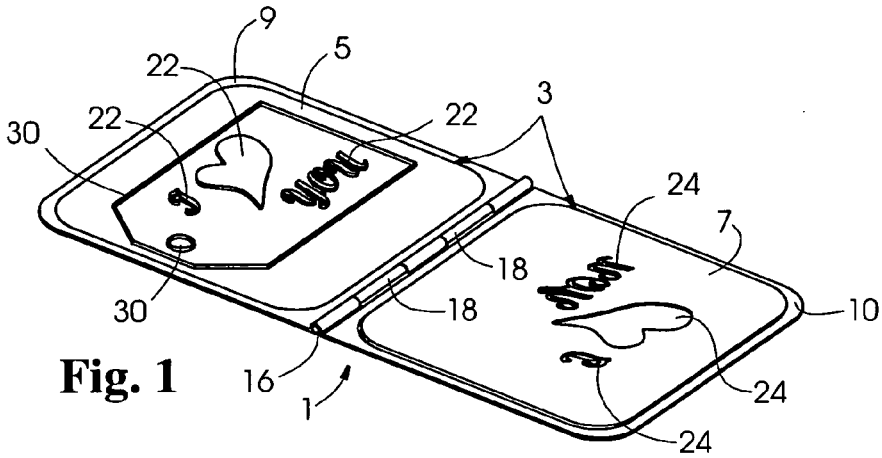
FIG. 1 shows a hinged cover in an open configuration for surrounding and aligning a cutting and embossing die set according to a preferred embodiment of this invention.
Figure 2:
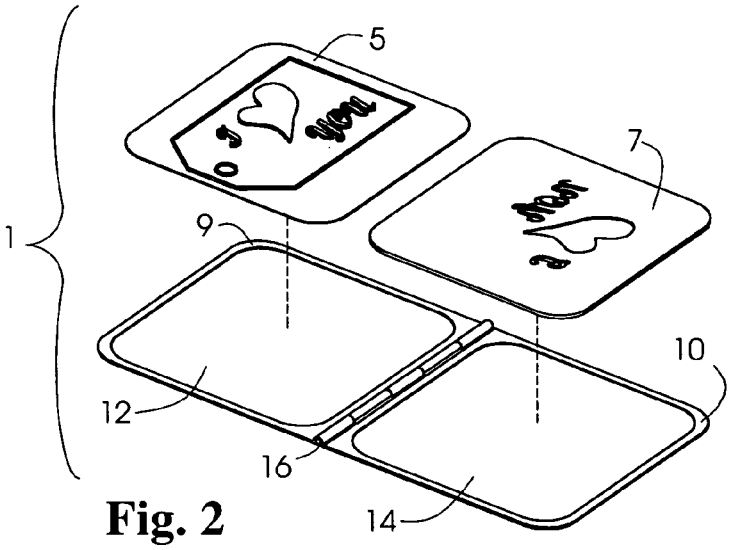
FIG. 2 shows a male die and a female counter-die from the die set of FIG. 1 to be attached to the hinged cover in the open configuration.
Figure 3:
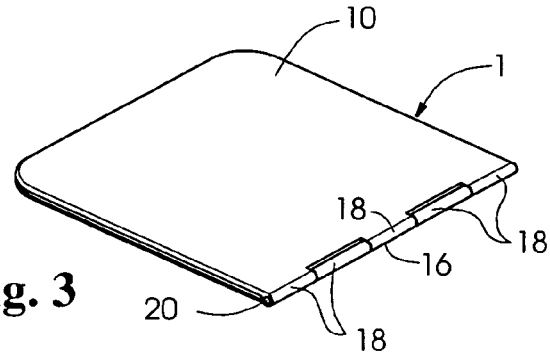
FIG. 3 shows the hinged cover rotated to a closed configuration.

The hinged cover 1 according to a preferred embodiment of this invention having particular application for aligning and enclosing a matched cutting and embossing die set 3 is initially disclosed while referring concurrently to FIGS. 1–3 of the drawings. The matched die set 3 includes a die 5 and a counter-die 7. FIG. 1 shows the die and counter-die 5 and 7 of die set 3 carried by adjacent backing members 9 and 10 of the hinged cover 1 in an open configuration. FIG. 2 shows the die and counter-die 5 and 7 being aligned for attachment at respective cavities 12 and 14 formed in the backing members 9 and 10 of cover 1. In FIG. 3, the die and counter-die 5 and 7 are seated within the cavities 12 and 14 (not shown), and the backing members 9 and 10 are rotated at an integral hinge 16 which runs along the interface of the adjacent backing members. In this manner, the die and counter-die 5 and 7 will lie one above the other with the hinged cover 1 in a closed configuration.

The backing members 9 and 10 of the hinged cover 1 are pivotally connected to one another by means of the aforementioned hinge 16 so as to be rotatable between the open configuration of FIG. 1 and the closed configuration of FIG. 3. In the embodiment illustrated, the hinge 16 includes a plurality of axially aligned hollow cylinders 18 that are alternately attached to the backing members 9 and 10. A pivot pin 20 (best shown in FIG. 3) runs longitudinally through the axially aligned cylinders 18 to establish an axis around which the backing members 9 and 10 can rotate. However, it is to be understood that other hinges, such as, for example, an integral living hinge which would extend continuously between the backing members 9 and 10 of cover 1 can be used in substitution of the hinge 16 so as to enable the backing members to rotate between the open and closed configurations.

Figure 4:
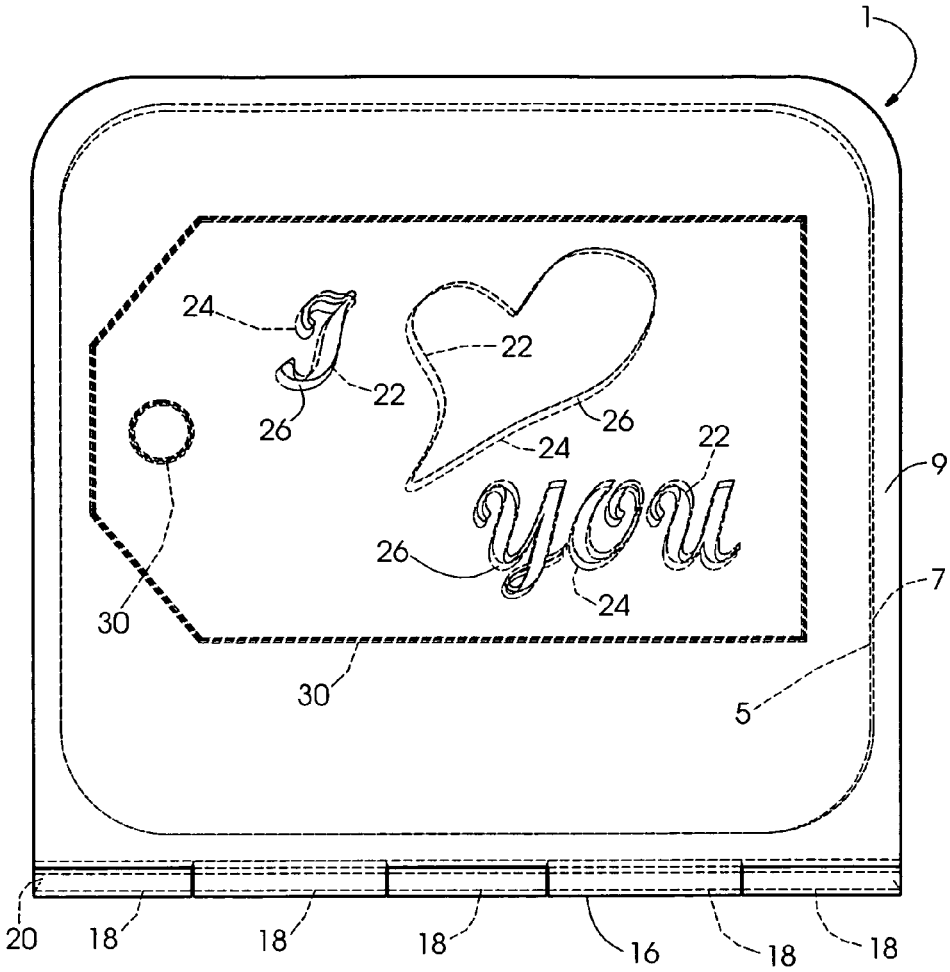
FIG. 4 shows the hinged cover in the closed configuration of FIG. 3 with the male die rotated into receipt by the female counter-die.
Figure 5:
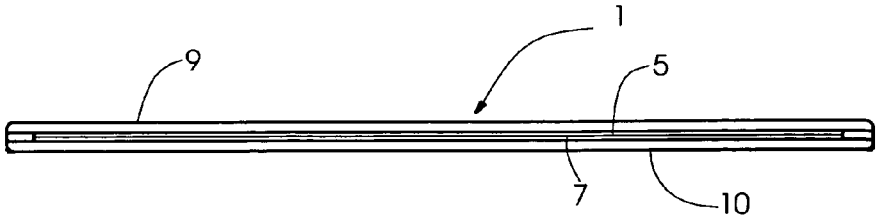
FIG. 5 is a front view of the hinged cover rotated to the closed configuration.

FIG. 4 of the drawings shows a top view of the hinged cover 1 in the closed configuration with the die and counter-die 5 and 7 of the cutting and embossing die set 3 rotated into opposing face-to-face alignment one above the other. Referring specifically to FIGS. 1 and 4, the die 5 is shown having one or more raised male portions 22. By way of example, the raised male portions 22 are arranged on the die 5 to form the letters and a design which illustrate the message "I LOVE YOU." However, the raised male portions 22 can include any other indicia and/or graphic designs to convey any one of a variety of different messages.

The counter-die 7 is shown having one or more opposing recessed female portions 24 that are complementary to the raised male portions 22 of die 5. That is, the recessed female portions 24 of the counter-die 7 are sized and shaped to receive therewithin the raised male portions 22 of die 5 when the backing members 9 and 10 are rotated to the closed configuration (of FIG. 1). As is best illustrated in FIG. 4, the recessed female portions 24 are offset from the raised male portions 22 by a gap 26 of approximately 0.015 inches. The raised male and recessed female portions 22 and 24 and the corresponding message to be illustrated are preferably made by a conventional chemical etching technique. The die and counter-die 5 and 7 of the cutting and embossing die set 3 on which the male and female portions 22 and 24 are formed, can be manufactured from any suitable metallic material such as steel, aluminum, or the like.

As is best shown in FIG. 1, the die 5 includes certain additional raised male portions 30 for which there is no complementary recessed female portion formed in the counter-die 7. Such additional raised male portions 30 are typically sharp edged. By way of example only, the additional raised male portions 30 in die 5 are arranged in the outline of a tag having a hole at one end of the tag through which to receive a tie, such as a string, for affixing the tag to a gift. The purpose of the raised male portions 22 and 30 on the die 5 and the recessed female portions 24 in the counter-die 7 will soon be described.

The backing members 9 and 10 of the hinged cover 1 are preferably manufactured from plastic, although the precise material from which backing members 9 and 10 are formed is not to be considered a limitation of this invention. As earlier described, the die and counter-die 5 and 7 of cutting and embossing die set 3 are received in respective cavities (designed 12 and 14 in FIG. 2) that are formed in the backing members 9 and 10. To prevent the die and counter-die 5 and 7 from moving out of alignment relative to one another within the cavities 12 and 14, the die and counter-die 5 and 7 may be adhesively bonded or otherwise secured within the cavities 12 and 14. By virtue of the cavities 12 and 14 formed in backing members 9 and 10, the raised male portions 22 can be automatically positioned and accurately aligned for a close tolerance fit within the recessed female portions 24 when the backing members 9 and 10 are rotated at hinge 16 to the closed configuration of the hinged cover 1 (of FIG. 3). That is to say, by maintaining the die and counter-die 5 and 7 in a fixed alignment with one another, there is less likelihood that the raised male portions 22 or the recessed female portions 24 will be damaged as might otherwise occur had the die and counter-die 5 and 7 been misaligned when the hinged cover 1 is rotated to the closed configuration.

The operation and use of the hinged cover 1 for the cutting and embossing die set 3 is now disclosed while referring concurrently to FIGS. 1–5 of the drawings. With the hinged cover 1 in the open configuration of FIG. 1, paper, plastic, foil or any other suitable sheet material (not shown) to be cut and embossed is laid on top of the counter-die 7 to cover the recessed female portions 24 formed therein. The backing member 9 of cover 1 is then rotated at hinge 16 to the closed position of FIG. 3 so as to lie above backing member 10 with the sheet material sandwiched between the die and counter-die 5 and 7.

Next, a compressive force is applied to the backing members 9 and 10 whereby the raised male portions 22 of die 5 press the sheet material into the recessed female portions 24 of the counter-die 7. Accordingly, the sheet material will be embossed with the message illustrated by the complementary raised and recessed male and female portions 22 and 24 of the die and counter-die 5 and 7. At the same time that the sheet material is embossed, the additional sharp edged raised male portions 30 of die 5 will cut the sheet material. That is to say, since the counter-die 7 is devoid of a complementary opposing recess in which to receive the additional raised male portions 30 of die 5, the sheet material will be cut along the shape defined by the sharp-edged male portions 30 which are forced against the solid face of counter-die 7.

The compressive force applied to the cutting and embossing die set 3 can be generated by locating the hinged cover 1 that is folded in the closed configuration of FIG. 1 in a conventional manually-operated roller press or between the jaws of a conventional manually operated platen press or a hand-held press. However, the press must be capable of generating sufficient pressure to be imparted through the backing members 9 and 10 to the raised male portions 22 and 30 of die 5 to simultaneously perform the embossing and cutting operations as just described. To this end, the backing members 9 and 10 provide the die set 3 with an additional thickness below a single roller, between a pair of rollers, or between the jaws of the press to enable a greater compressive force to be imparted from the press to the die and counter-die 5 and 7 for enhancing the embossing and cutting operations.

I claim:

1. A combination comprising:

a first die having a first raised male portion projecting outwardly therefrom;

a second die having a first recessed female portion formed therein, the first recessed female portion of said second die being sized and shaped to receive therewithin the first raised male portion of said first die for embossing a sheet material located between said first and second dies in response to a compressive force applied thereto;

a first backing member carrying said first die;

a second backing member carrying said second die and pivotally coupled to said first backing member;

an integral hinge by which said first and second backing members are pivotally coupled to one another, said integral hinge establishing a single pivot axis along the interface between said first and second backing members around which said first and second backing members rotate relative to one another; and each of said first and second backing members having a recessed cavity formed therein, and said first and second dies being received within and fixedly connected to respective ones of said recessed cavities, said integral hinge preventing said first and second backing members from shifting relative to one another and the receipt and affixation of said first and second dies within said recessed cavities preventing said first and second dies from moving relative to one another, whereby the first raised male portion of said first die is automatically positioned and accurately aligned for a close tolerance fit within the first recessed female portion of said second die when said first and second backing members are rotated towards one another at said integral hinge therebetween so as to lie one above the other to thereby prevent damage to the first raised male portion and the first recessed female portion when said first raised male portion is received within said first recessed female portion.

2. The combination recited in claim 1, wherein said first and second dies are adhesively affixed within the said respective ones of said recessed cavities formed in said first and second backing members.

3. The combination recited in claim 1, wherein said first and second backing members are manufactured from plastic.

4. The combination recited in claim 1, wherein said first die has a second raised male portion projecting outwardly therefrom to be moved into engagement with said second die for cutting the sheet material located between said first and second dies in response to the compressive force applied thereto.

5. The combination recited in claim 1, wherein said integral hinge includes a rigid pivot pin that runs continuously along the interface between said first and second backing members to establish said single pivot axis around which said backing members rotate relative to one another.

* * * * *